US006065385A

United States Patent [19]

Steward et al.

[11] Patent Number: 6,065,385

[45] Date of Patent: May 23, 2000

[54] BUCKET CARRIER FOR MOLDED SOLID PROPELLANT STORAGE MAGAZINE

[75] Inventors: Anthony R. Steward, Essex Junction; David L. Maher; Michael J. Laurin, both of Burlington, all of Vt.

[73] Assignee: General Dynamics Armament Systems, Inc., Falls Church, Va.

[21] Appl. No.: 09/144,256

[22] Filed: Aug. 31, 1998

Related U.S. Application Data

[60] Provisional application No. 60/071,466, Jan. 14, 1998.

[51] Int. Cl.[7] ..... F41A 9/34

[52] U.S. Cl. ..... 89/35.01; 89/45; 198/803.8

[58] Field of Search ..... 414/470; 89/35.01, 89/45, 46, 34; 198/803.1, 803.8, 803.13

[56] References Cited

U.S. PATENT DOCUMENTS

| | | | |
|---|---|---|---|
| 1,138,149 | 5/1915 | Reichard | 89/46 |
| 1,652,277 | 12/1927 | Herold | 198/803.13 |
| 2,365,028 | 12/1944 | Vesely | 89/35 |
| 2,475,380 | 7/1949 | Elder | 89/35 |
| 2,494,728 | 1/1950 | Stacey et al. | 89/33 |
| 2,947,222 | 8/1960 | Bilek et al. | 89/35.01 |
| 3,178,005 | 4/1965 | Read | 198/24 |
| 3,501,996 | 3/1970 | Lipp et al. | 89/34 |
| 3,575,275 | 1/1969 | Reimers et al. | 198/24 |
| 3,580,131 | 5/1971 | Zimmerman | 89/34 |
| 3,696,704 | 10/1972 | Backus et al. | 89/34 |
| 4,125,052 | 11/1978 | Thomas | 89/34 |
| 4,166,408 | 9/1979 | Wetzel et al. | 89/33 |
| 4,392,414 | 7/1983 | Koine | 89/35.01 |
| 4,619,181 | 10/1986 | Pehker et al. | 89/34 |
| 4,724,739 | 2/1988 | Piccotti | 72/203 |
| 4,727,790 | 3/1988 | DeHaven et al. | 89/46 |
| 4,772,171 | 9/1988 | Mayer et al. | 414/125 |
| 4,876,940 | 10/1989 | Aloi et al. | 89/34 |
| 4,951,547 | 8/1990 | Novet et al. | 89/34 |
| 5,097,742 | 3/1992 | Gaye et al. | 89/34 |
| 5,175,388 | 12/1992 | Maher et al. | 89/35.01 |
| 5,212,338 | 5/1993 | Maher | 89/45 |
| 5,289,754 | 3/1994 | Elpass | 89/46 |
| 5,594,194 | 1/1997 | Steward et al. | 89/46 |

FOREIGN PATENT DOCUMENTS

| | | | |
|---|---|---|---|
| 3733214 | 4/1989 | Germany . | |
| 53-31400 | 3/1978 | Japan . | |
| 109491 | 1/1944 | Sweden . | |
| 7468 | of 1896 | United Kingdom | 89/35.01 |

*Primary Examiner*—Stephen M. Johnson

*Attorney, Agent, or Firm*—Finnegan, Henderson, Farabow, Garrett & Dunner

[57] ABSTRACT

A linked bucket carrier for safely transporting molded, solid-propellant charges between a transport conveyor and respective storage magazines is described. The propellant charge carrier includes an elongated body having an arc-shaped cross section that defines an elongated slot which is divided into compartments by spacers so that the carrier is capable of holding at least two propellant charges. The carrier may further include clamping fingers extending from the body and arranged on the body in opposing pairs, and the fingers may be pre-formed so that they define an out-of-round cross section adapted to clamp the propellant charges when the propellant charges are positioned within the body.

19 Claims, 9 Drawing Sheets

BUCKET CARRIER FOR MOLDED SOLID PROPELLANT STORAGE MAGAZINE

I. REFERENCE TO RELATED APPLICATIONS

The invention disclosed herein has particular application to transfer mechanisms for moving large caliber ammunition in and out of storage magazines, such as disclosed in U.S. Pat. No. 5,212,338 ("the '338 patent"). The disclosure of the '338 patent is incorporated herein by reference. The present application also claims priority from U.S. Provisional Application No. 60/071,466 filed Jan. 14, 1998 . The application is also related to U.S. patent application Ser. No. 09/144,623 Joseph A. L. N. Gagnon, entitled "TRANSFER MECHANISM FOR UPLOADING AND DOWNLOADING PROPELLANT CHARGES AND PROJECTILES," which is filed concurrently herewith and incorporated herein its entirety by this reference.

This invention was made with Government support under Contract No. DAAE30-95-C-0009 awarded by the United States Army. The Government has certain rights in the invention.

II. FIELD OF THE INVENTION

The present invention relates to transfer mechanisms for moving storable items between storage spaces and a common outside location, particularly propellant charges for large caliber guns between associated, adjacent storage magazines and a munitions conveyor. More specifically, the present invention relates to a multi-compartment, bucket carrier for holding molded solid propellant charges in a storage magazine as the charges are transported to another location.

III. BACKGROUND OF THE INVENTION

Transfer mechanisms and bucket carriers designed automatically to move larger caliber ammunition projectiles in and out of storage magazines have been developed for use in various military vehicles. An example of one such system of transfer mechanisms and bucket carriers is described in the '338 patent. That system is intended to handle only ammunition projectiles, since the bag propellant charges used to propel those projectiles conventionally were loaded manually in such a system. Such manual loading of bag propellant charges is typical of most conventional large caliber weapons systems.

The planned introduction of advanced artillery systems calls for the use of a fully automated ammunition handling capability including handling of the propellant charges. For one of these advanced systems, the propellant charges will be molded, combustible containers filled with either ball or stick propellant. An illustration of these new propellant charge modules, referred to as Modular Artillery Charge Systems (MACS), is shown schematically in FIG. 1 and is designated by the numeral 10. The MAC modules each include a combustible case body 12, a combustible case coating 14, and combustible case caps 20, 22. Individual powder grains 18 are contained within case body 12 and case caps 20, 22, arrayed around a central core 24 bounded by adaptor cups 26, 28 and covers 30, 32.

As one skilled in the art would appreciate, in operating a large caliber gun such as a self-propelled Howitzer, a selective number of the individual propellant charges 10 would be used, depending upon the type of projectile, range, etc. required. The MACS transfer mechanism then ideally must be able to selectively transfer into or access from, the storage magazine any single charge, or multiple charges up to all the charges in the carrier. Moreover, space and weight concerns for an automated gun supply system may necessitate a common transfer mechanism to serve a projectile storage magazine on one side of a common conveyor and a MACS module storage magazine on the other side.

However, known transfer mechanisms are configured for handling a single elongated projectile from magazine carriers such as described in the '388 patent. Whereas each carrier in a projectile, magazine stores only one projectile it would be desirable and more space efficient to store multiple MACS modules in a single carrier. This disclosure describes the mechanization of a propellant charge carrier suitable for use with advanced MACS and further describes a multi-compartment bucket particularly suited for use with such a carrier.

IV. SUMMARY OF THE INVENTION

The design and implementation of a portion of a mechanically operated ammunition magazine intended to handle and store molded solid propellant charges is generally described. The mechanization of a bucket carrier intended to handle the propellant charges within such a storage magazine is more specifically described. The unique features of the bucket carrier described herein are its simple, low-cost construction, its partitioning system, and its use of integral, flexible members to secure, with a nearly constant clamping force, the charge into the carrier.

An objective of the present invention is to provide a multi-compartment bucket carrier capable of safely receiving, transporting, and unloading storable items, some of which may be combustible, between a storage location and a delivery location.

Additional objectives and advantages of the invention will be set forth in part in the description which follows, and in part will be obvious from the description, or may be learned by practice of the invention. The objectives and advantages of the invention will be realized and attained by means of the elements and combinations particularly pointed out in the appended claims.

To achieve the objects and in accordance with the purpose of the invention, as embodied and broadly described herein, a carrier for generally cylindrical items according to the invention comprises: an elongated body with an arc-shaped cross section body having a first end and a second end and defining an elongated slot adapted to accommodate at least two items during loading, unloading and transport of each of the items, a first end plate connected to the first end of the body; a second end plate connected to the second end of the body; and a spacer connected within the body between the first end plate and the second end plate defining positions for the items. The carrier may further include clamping fingers extending from the body and arranged on the body in opposing pairs, and the fingers may be pre-formed in an out-of-round shape adapted to clamp positively the items when the items are positioned within the body.

The foregoing general description and the following detailed description are exemplary and explanatory only and are not restrictive of the invention, as claimed. The accompanying drawings, which are incorporated in and constitute a part of this specification, illustrate one embodiment of the invention and together with the description, serve to explain the principles of the invention.

V. BRIEF DESCRIPTION OF THE DRAWINGS

Figure 8:
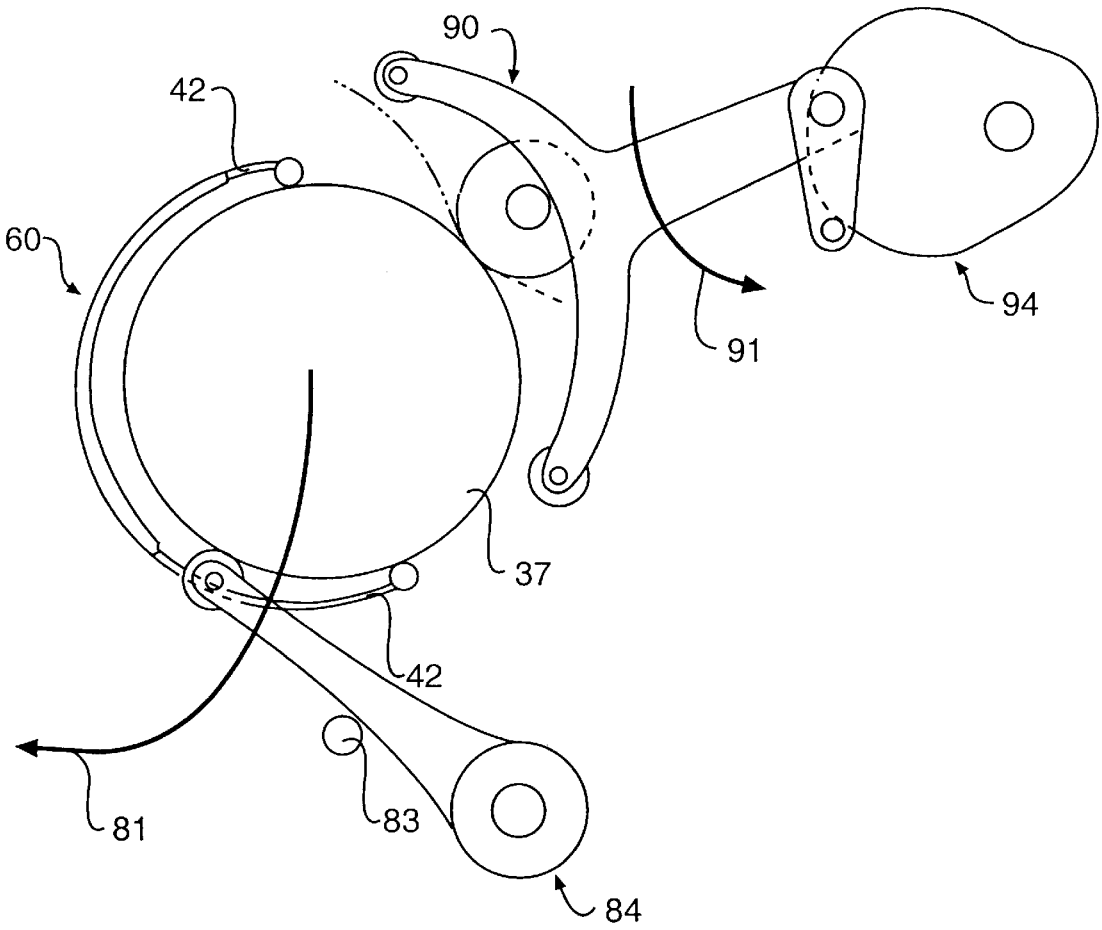
Figure 9:
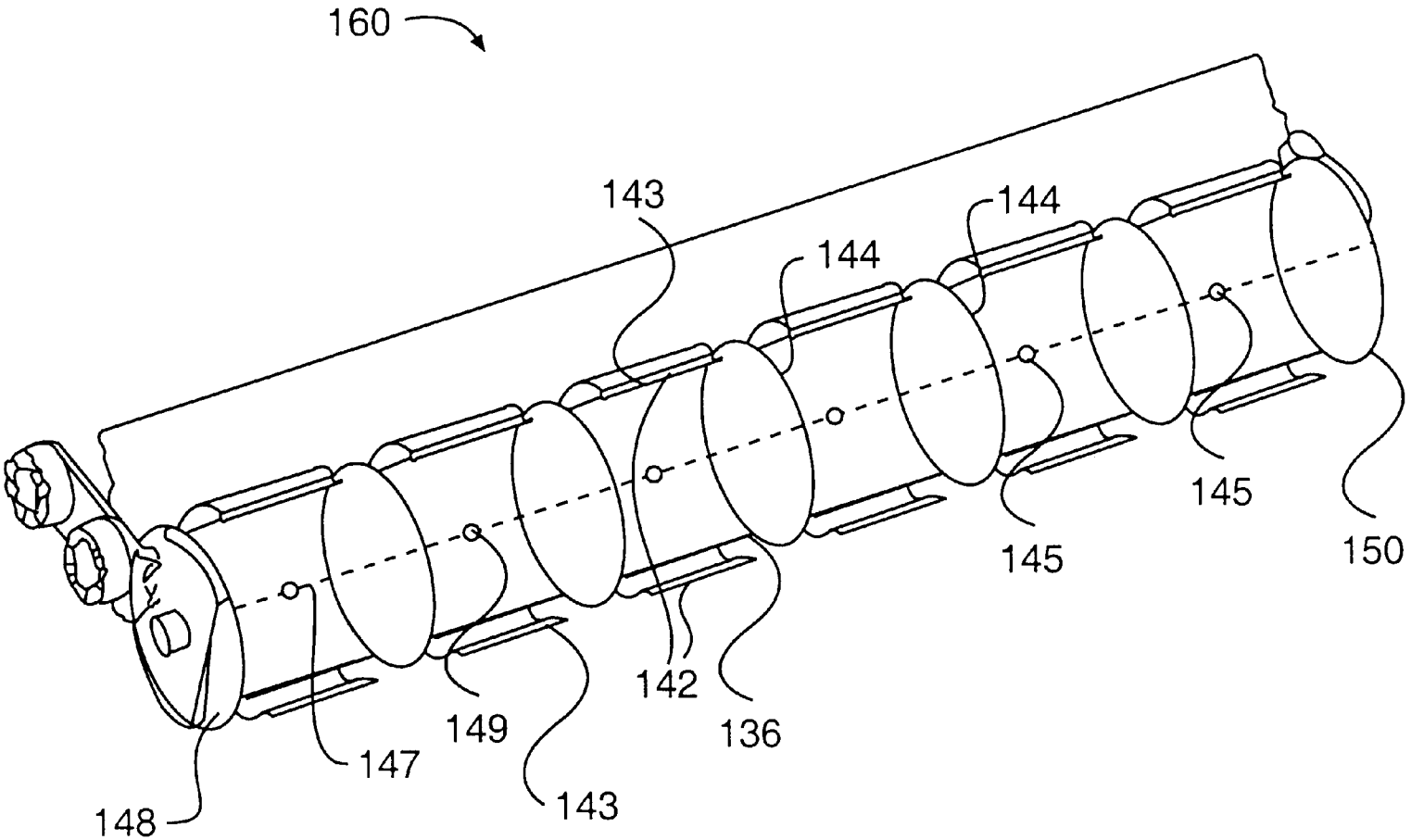

FIG. 8 is a schematic illustration of a portion of a transfer mechanism suitable for use with the carrier according to the present invention and the manner in which propellant charges may be withdrawn from the carrier; and FIG. 9 is a schematic perspective view of another embodiment of a bucket carrier according to the present invention having six compartments, which depicts an alternative structure for the opposing pairs of clamping fingers.

VI. DESCRIPTION OF THE PREFERRED EMBODIMENT

Reference will now be made in detail to an exemplary preferred embodiment of the invention, which is illustrated in the accompanying drawings. Wherever possible, the same reference numbers will be used throughout the drawings to refer to the same or like parts.

A. Propellant Charge Bucket Carrier Design

In accordance with the invention, a carrier is configured to hold at least two items for storage or transport or both. The carrier comprises an elongated, bucket-like body having an arc-shaped cross section. One plate mounted on each end of the body and at least one spacer connected to the body between the end plates define at least two compartments within the body for holding items within the carrier. The body may also include opposing pairs of clamping fingers configured to hold more positively the items within the carrier.

As embodied herein, a carrier 60 made in accordance with the present invention, to be described in more detail hereinafter, is configured as a bucket carrier for storing propellant charges, in particular MACS, in a magazine. However, the present invention is not to be limited to carriers for storing propellant charges or even to military applications. Rather the invention is intended to be limited only by the appended claims and their equivalents.

Figure 1:
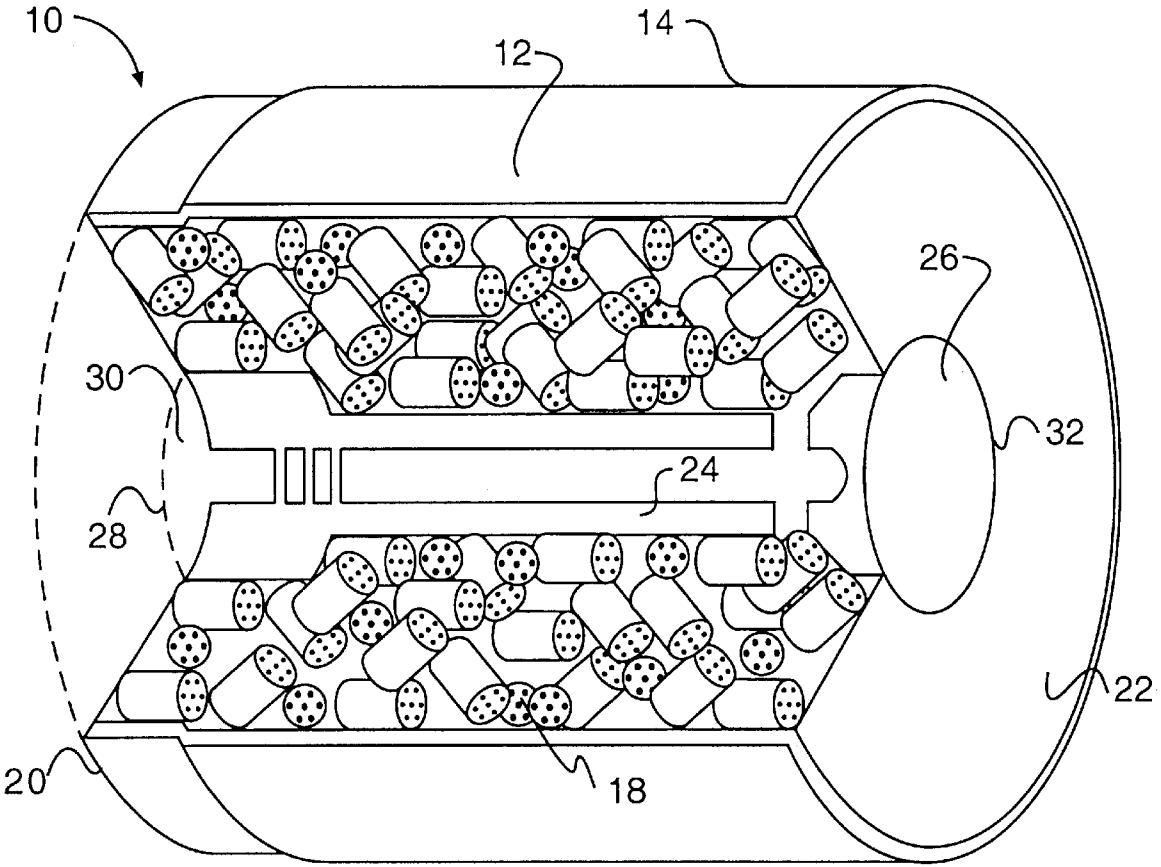
FIG. 1 is a schematic perspective, cut-away view of a storable molded propellant charge module that can be selectively transferred using the present invention.
Figure 2:
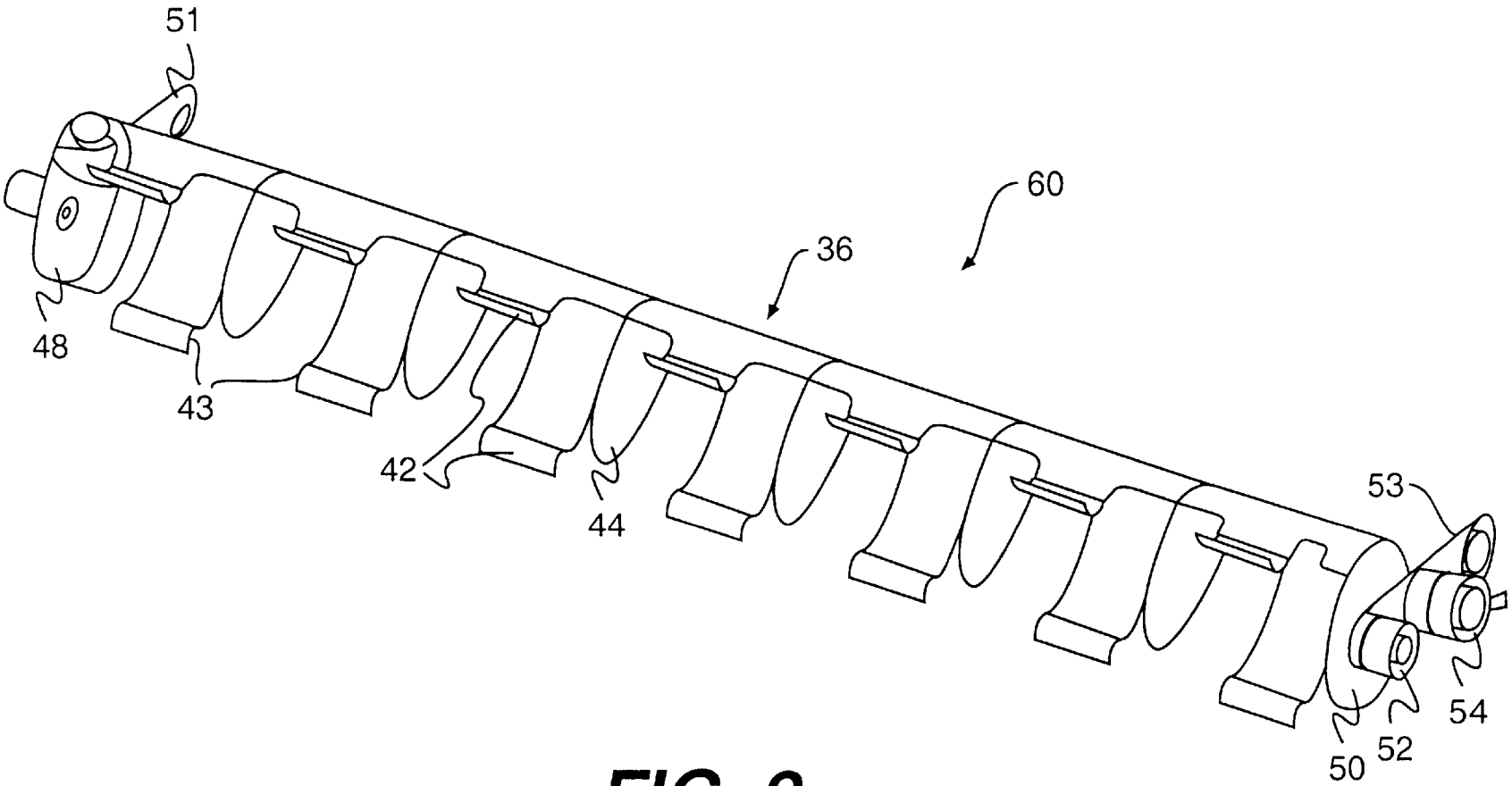
FIG. 2 is a schematic perspective view of an embodiment of a bucket carrier according to the present invention having seven compartments, and opposing pairs of clamping fingers.
Figure 3:
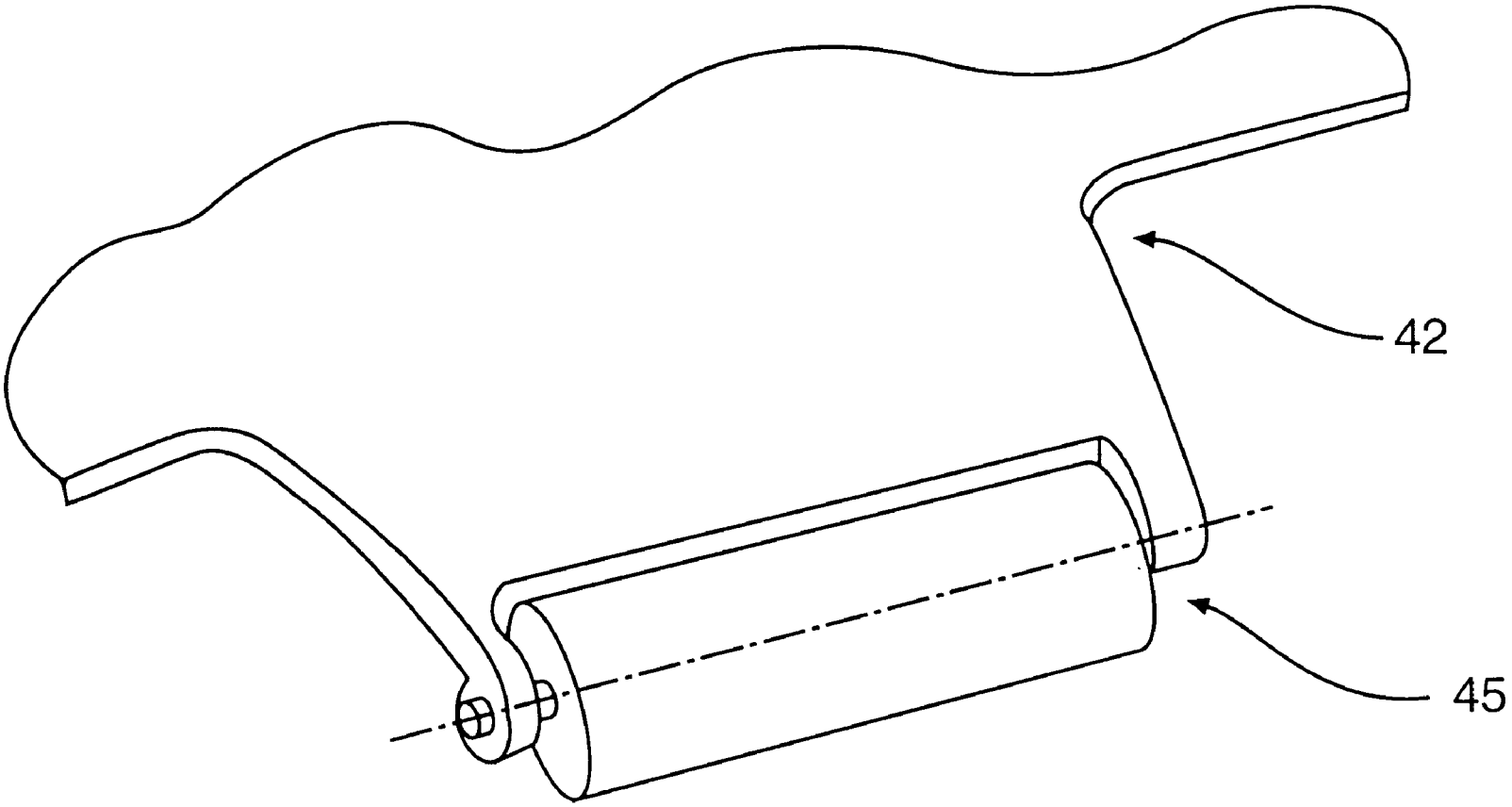
FIG. 3 is a schematic perspective, cut-away view of the end of one of the clamping fingers shown in FIG. 2, illustrating a roller on the tip of the finger.
Figure 4:
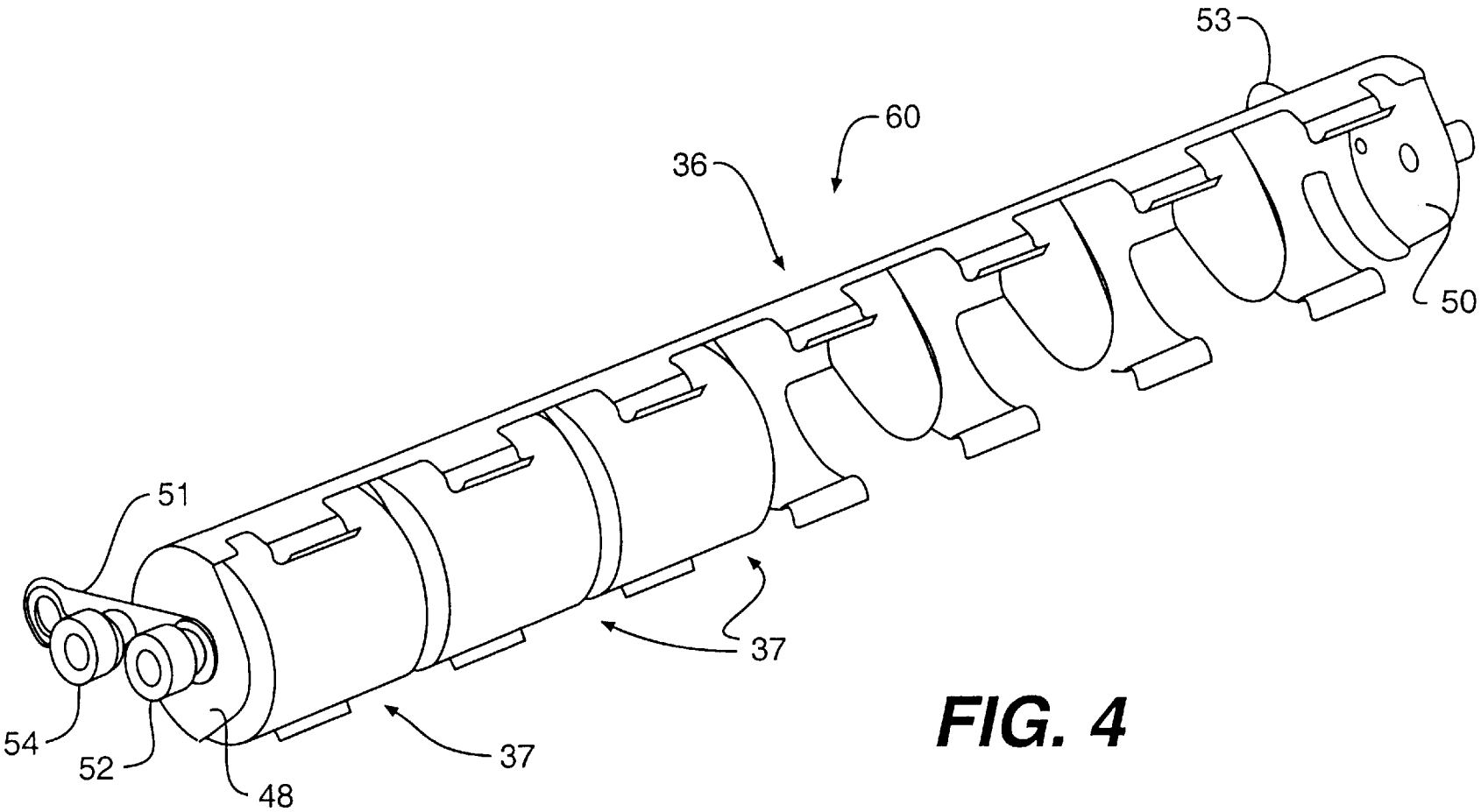
FIG. 4 is a schematic perspective, depicting a completely assembled bucket carrier according to the present invention in which three molded propellant charges are loaded into the carrier.

A seven-compartment bucket carrier 60 according to the invention is shown in FIG. 2. It includes a cylindrical metal (or plastic) carrier body 36 with sections cutout leaving pairs of clamping fingers 42 extending from its longitudinal center section. These fingers 42 (one pair for each propellant charge to be captured) may be preformed to be out-of-round in their normal relaxed state. Thus, each opposing pair of clamping fingers 42 will positively grip a charge 37 (as shown in FIG. 4) having a circular cross section when that charge is inserted into the carrier body 36 between the pair of clamping fingers 42. The ends 43 of the fingers 42 are preferably curved outward somewhat to allow a charge to pass easily in and out of the paired fingers without gouging the outer surface of the charge. An alternate form of this clamping finger end 43 is to incorporate metal or plastic rollers 45 in this area to further reduce friction loads during insertion and extraction of the propellant charge. FIG. 3 shows this roller arrangement.

As seen in FIGS. 2 and 4, six spacers 44 (e.g., metal or plastic) are riveted, welded, molded or otherwise fastened to the body 36 of the carrier 60 to locate properly each charge 37 within the length of the carrier 60. Positioning accuracy of the propellant charges 37 within the carrier 60 is necessary in order to allow for proper transfer of the charges 37 in and out of the carrier by means of a mechanism described later. In addition, the spacers 44 serve as positive stops for the charges 37 in the event the charges 37 are accelerated laterally due to an impact to the vehicle. The spacers 44 also provide a degree of flame protection between charges 37 in the unlikely event of an onboard fire. These spacers 44 would tend to slow the propagation of fire between charges 37 in the carrier 60. Of course, it should be understood that more than one set of clamping fingers 42 may be positioned between spacers 44.

Two end plates 48, 50 are attached to opposite ends of the body 36 of the carrier 60, together with their integral link members 51, 53, complete the bucket carrier structure. Two rollers 52, 54 are attached to each link 51, 53. One roller 52, located on the centerline of the carrier 60, serves as a chain guide/support and engages a sprocket drive mechanism 76 used to move the carriers 60 within the ammunition magazine 70, whereas, the other roller 54, located in the middle of the link 51 or 53, serves only to engage the sprocket drive mechanism 76. FIG. 4 shows a completely assembled carrier 60 with three charges 37 properly positioned and secured within the carrier 60.

B. Linked Bucket Carrier Conveyor

Figure 5:
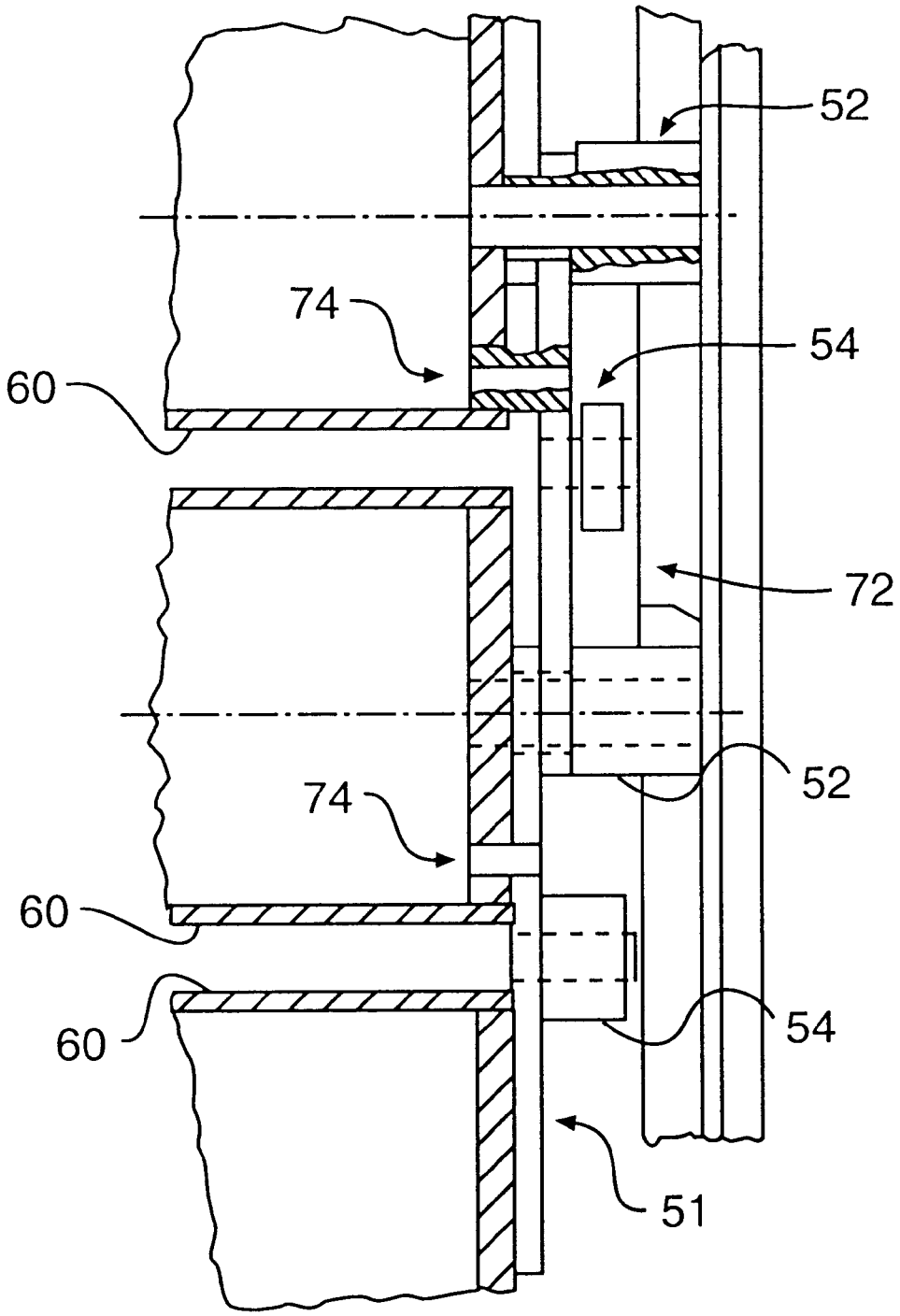
FIG. 5 is a schematic-cross sectional view of a bucket carrier according to the present invention illustrating the links that form the interface between the carrier and the mechanism for driving the carrier within a storage magazine suitable for use with the carrier.
Figure 6:
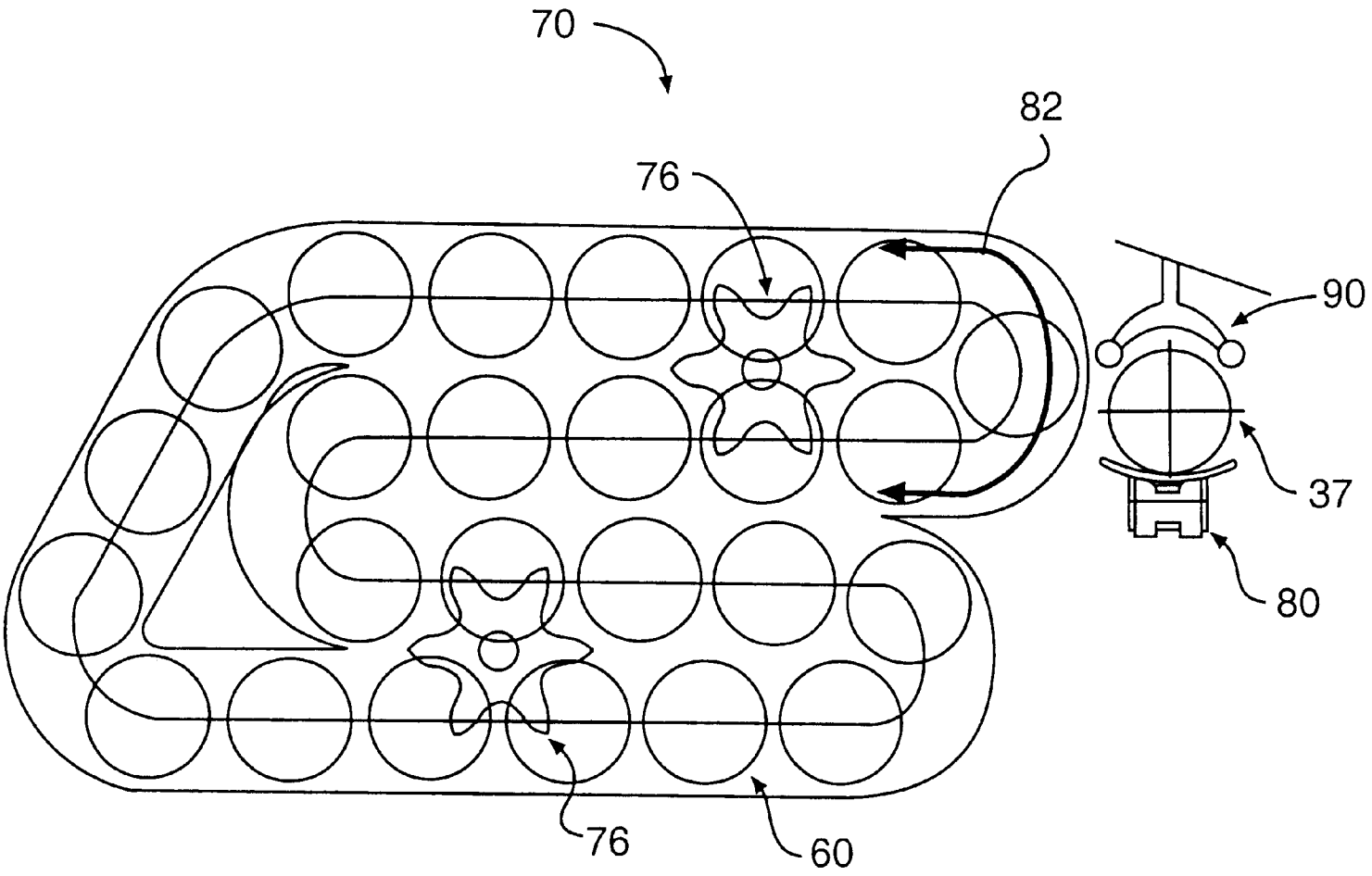
FIG. 6 is a schematic end view of a propellant storage magazine, an axial conveyor and a hand off fork suitable for use with a bucket carrier according to the present invention.

FIG. 5 is a cross section view of a portion of the bucket carrier 60 illustrating the linkage with a drive mechanism and magazine suitable for use with the carrier 60. The support and drive rollers 52 and drive rollers 54 attached to their carriers 60 through their links 51 and links 53 (not shown in FIG. 5), are shown in relation to the magazine support structure 72. Also shown is a pin 74 which anchors each carrier 60 to its respective link 51, it being understood that similar pins 74 also are provided for links 53 (not shown). These pins 74 prevent the carriers 60 from rotating in relation to the links 51 and 53 to which they are attached. FIG. 6 shows an schematic end view of an entire storage magazine 70, containing 25 bucket carriers 60. Also shown is the axial conveyor 80 that would transport the propellant charges 37 to and from the magazine 70. The transfer of the propellant charges 37 to/from the storage magazine 70 is accomplished by the handoff fork 90.

C. Upload/Download Operation

Figure 7:
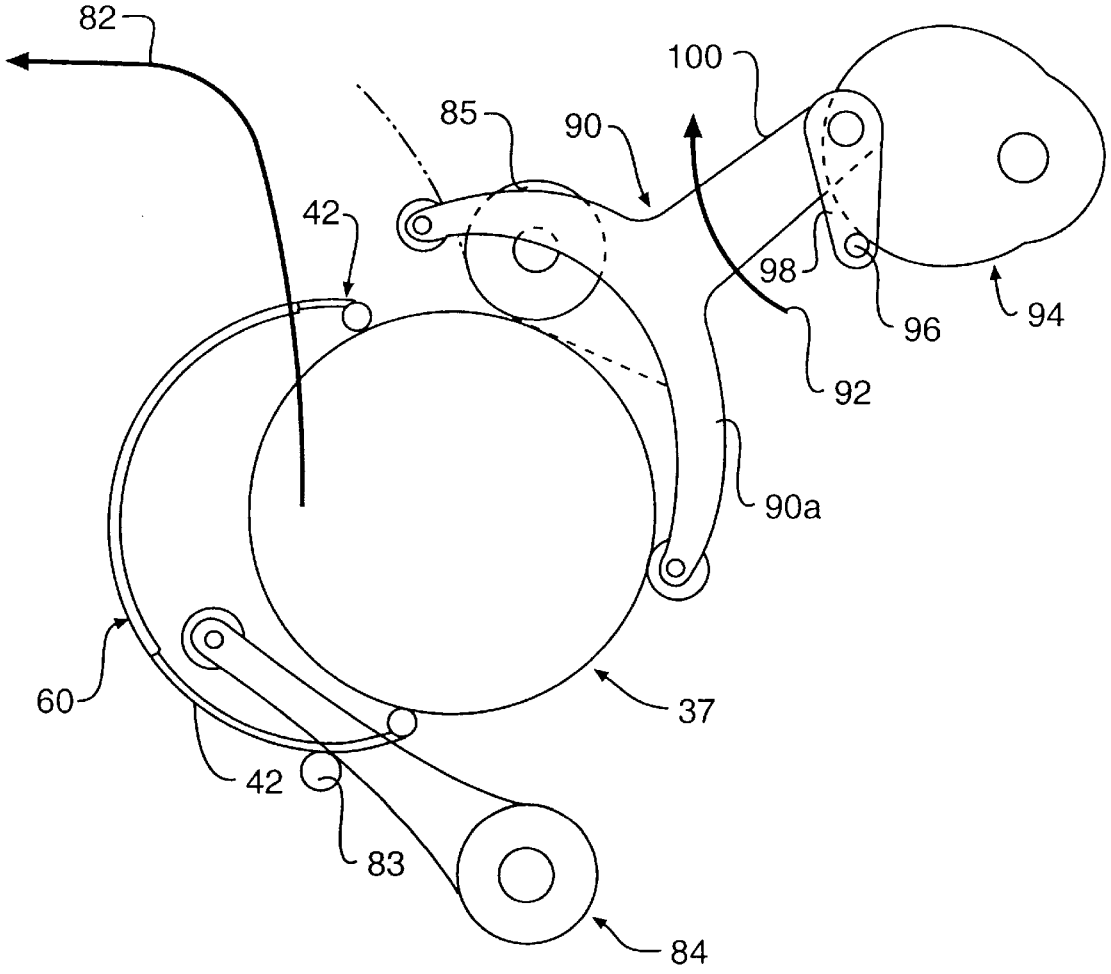
FIG. 7 is a schematic illustration of a portion of a transfer mechanism suitable for use with the carrier according to the present invention and the manner in which propellant charges may be inserted into the carrier.

FIGS. 7 and 8 illustrate inserting and withdrawing the propellant charge 37 into/from the bucket carriers 60 utilizing an ammunition transfer mechanism similar to that described in the '388 patent and detailed in the co-pending application of Joseph A. L. N. Gagnon filed concurrently herewith and provisional application 60/071,465, the disclosures of which are incorporated in their entirety herein by this reference. To insert a propellant charge 37 the bucket carrier serpentine conveyor 70 is moving in a counterclockwise manner in the hand-off area 82. A set of transfer forks 90 mounted on a common shaft are rotated in a clockwise direction 92 by an operating cam 94 acting on a cam follower 96 carried at the free end of a crank arm 98 affixed to a transfer fork shaft. In the process, a charge 37 is rolled off an axial conveyor 80 (shown in FIG. 6) by the roller-tipped trailing transfer fork tine 90*a* and ultimately onto the upper surface of a set of selector gates 84 carried on a common shaft which are swung counterclockwise to their illustrated positions against a stop 83 by the charge 37. The operating cam 94 is driven, with appropriate timing to the serpentine conveyor 70, such that the transfer fork 90 presents the charge 37 to the open slot of a bucket carrier 60 at the proper moment. Continued motion of the transfer fork 90 and counterclockwise motion of the conveyor 70, in concert with the presence of a fixed insertion roller 85, produces an insertion force on the bucket carrier 60 to flex the fingers 42 outwardly and widen the slot opening, clearing the way for insertion of the charge 37 into the bucket 60. Once in place, the fingers 42 snap back restraining the charge 37 in position. Note that the selector gates 84 are longitudinally positioned on their shaft in alignment with the gaps between fingers 42, such that in the illustrated insertion positions, interference with the bucket carriers 60 is avoided.

To withdraw a propellant charge 37, the selector gates 84 are driven to their counter clock-wise position against the stop 83, and the transfer forks 90 are driven to their clockwise-most position as illustrated in FIG. 8 in proper timed relation to the clockwise entry 81 of a bucket carrier 60 into the hand-off area. As the charge 37 to be downloaded engages the roller tips of the selector gates 84, continued clockwise motion of the carrier 60, creates the force necessary to flex the fingers 42 open sufficiently to allow the charge 37 to be snapped out of the bucket carrier 60 into the hand-off fork 90. As the bucket carrier 60 continues on, the now free charge 37 rolls down over the upper surfaces of the selector gates 84 under the control of the transfer forks 90 which are now being swung in the counter clockwise direction 91 by the operating cam 94.

FIG. 9 is an illustration of an another embodiment of a carrier according to the invention in which an alternative structure for the clamping fingers is shown. Carrier 160 includes a body 136 that is an elongated spine that is curved into an arc of approximately 110°. Attached to body 136 are a plurality of clamping fingers 142, which are constructed of strips of material that are bent into a generally C-shaped configuration with outwardly turned ends 143.

The radius of the arc in which clamping fingers 142 are formed near midline 147 is preferably smaller than the radius of the arc in which body 136 is formed. Clamping fingers 142 may also be formed in an out-of-round shape as described above in connection with clamping fingers 42. Clamping fingers 142 are preferably attached at approximately along midline 147 of the clamping fingers 142 and body 136 using, for example, rivets 149 or some other type of localized fastening technique (e.g., bolting or spot welding). When the is smaller-radius clamping fingers 142 are attached to body 136, clamping fingers 142 are preloaded in a position in which ends 143 are spread apart farther than they would be in the relaxed state of clamping fingers 142.

The smaller radius and midline attachment of clamping fingers 142 to body 136 results in a more constant clamping force being applied by clamping fingers 142 to the objects held in carrier 160. Because clamping fingers 142 are attached to body 136 using a localized fastening technique only along the midline 147, the length of clamping finger 142 that is deflected when ends 143 are spread apart is maximized. For a given thickness and material used to form clamping fingers 142, the maximized length of the deflected portion of clamping fingers 142 reduces the effective spring constant of clamping fingers 142. Preloading ends 143 of clamping fingers 142 in an open state increases the initial force required to spread apart ends 143, but permits the use of a material or thickness for clamping fingers 142 having an even lower effective spring constant. Thus, the initial value of the clamping force generated by clamping fingers 142 is closer to the highest value of clamping force permitted for clamping fingers 142, which results in a more nearly constant clamping force generated by clamping fingers 142 for all positions through which ends 143 of clamping fingers 142 move when carrier 160 is loaded and unloaded with objects. This feature of clamping fingers 142 is especially important when carrier 160 is used to hold volatile propellant charges. Additionally, the nearly constant clamping force generated by clamping fingers 142 renders them compatible with more than one diameter of object to be held in carrier 160.

It will be apparent to those skilled in the art that various modifications and variations can be made in the propellant charge bucket carrier of the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A carrier for generally cylindrical items, comprising:

a. an elongated body with an arc-shaped cross-section having a first end and a second end and defining an elongated slot sized to accommodate at least two of the generally cylindrical items;

b. a first end plate connected to the first end of the body;

c. a second end plate connected to the second end of the body;

d. a spacer connected within the body between the first end plate and the second end plate defining positions separated in a direction of elongation, each position for accommodating at least one item; and e. a plurality of clamping fingers extending from the body and arranged on the body in opposing pairs.

2. The carrier of claim 1, further comprising a first support roller extending from the first end plate and a second support roller extending from the second end plate.

3. The carrier of claim 2, in which the body defines a longitudinal axis with which the first and second support rollers are aligned.

4. The carrier of claim 3, further comprising:

a. a first link connected to the first support roller;

b. a second link connected to the second support roller;

c. a first drive roller connected to the first link; and d. a second drive roller connected to the second link.

5. The carrier of claim 1, further comprising a plurality of end rollers each of which is attached to an end of one of the plurality of clamping fingers.

6. The carrier of claim 1, in which the opposing pairs of clamping fingers are preformed to define an out-of-round cross section adapted to clamp the items when the items are positioned within the body.

7. The carrier of claim 1 in which the body is sized to accommodate a plurality of N items, where N is an integer >2, and in which a plurality of N−1 spacers are provided.

8. The carrier of claim 1, in which the clamping fingers are formed in pairs separately from the body, and each formed pair is attached to the body along a midline of the formed pair.

9. The carrier of claim 8, in which the clamping fingers in each pair define an arc having a first radius proximate the midline that is smaller than a second radius of an arc defined by the body at a location of attachment of the respective clamping finger pair.

10. The carrier of claim 9, in which each of the pairs of clamping fingers is attached to the body using a localized fastening technique.

11. The carrier of claim 10, in which the localized fastening technique is selected from the group of riveting, bolting or spot welding.

12. The carrier of claim 8, in which each of the pairs of clamping fingers is attached on an outer surface of the body.

13. The carrier of claim 9, in which each pair of the clamping fingers is attached on an outer surface of the body.

14. The carrier of claim 1, in which at least a respective one of the opposing pairs of clamping fingers is positioned on each side of the spacer.

15. The carrier of claim 1, in which each of the opposing pairs of clamping fingers is:

a. formed separately from the body such that a predetermined separation exists between ends of the opposing pair of clamping fingers; and b. attached to the body so that the distance between the opposing pair of clamping fingers exceeds the predetermined separation.

16. The carrier of claim 15, in which each of the opposing pairs of clamping fingers is attached along a midline of the opposing pair of clamping fingers to an outer surface of the body.

17. A carrier for one or more generally cylindrical items, comprising:

a. an elongated body with an arc-shaped cross-section:

i. having a first end and a second end, and ii. defining a longitudinal axis and a first concave surface having a first radius of curvature; and b. a plurality of separately formed opposing pairs of clamping fingers, each of which pairs:

i. defines a midline, a second concave surface having a second radius of curvature proximate the midline that is smaller than the first radius of curvature, and a slot configured to receive the items, and ii. is attached to the elongated body using a localized fastening technique near the midline of the opposing pair of clamping fingers such that the midline and the longitudinal axis of the elongated body are substantially aligned and the second concave surface of the opposing pair of clamping fingers is adjacent a convex surface of the elongated body opposed to the first concave surface.

18. The carrier of claim 17, further comprising a spacer connected to the elongated body between two of the plurality of opposing pairs of clamping fingers, said spacer defining positions separated along the longitudinal axis, each position for accommodating at least one item.

19. The carrier of claim 18, further comprising a first end plate connected to the first end of the elongated body and a second end plate connected to the second end of the elongated body.

* * * * *